US008196400B2

(12) United States Patent
Palo

(10) Patent No.: US 8,196,400 B2
(45) Date of Patent: Jun. 12, 2012

(54) METHOD AND AN ARRANGEMENT FOR CONTROLLING PUMP DISPLACEMENT IN A WORK VEHICLE

(75) Inventor: Markku Palo, Eskilstuna (SE)

(73) Assignee: Volvo Construction Equipment AB, Eskilstuna (SE)

( * ) Notice: Subject to any disclaimer, the term of this patent is extended or adjusted under 35 U.S.C. 154(b) by 583 days.

(21) Appl. No.: 12/160,620

(22) PCT Filed: Mar. 13, 2006

(86) PCT No.: PCT/SE2006/000323

§ 371 (c)(1),
(2), (4) Date: Jul. 11, 2008

(87) PCT Pub. No.: WO2007/105993

PCT Pub. Date: Sep. 20, 2007

(65) Prior Publication Data

US 2009/0031721 A1 Feb. 5, 2009

(51) Int. Cl.
*F15B 11/16* (2006.01)
*F15B 11/042* (2006.01)

(52) U.S. Cl. ..... 60/449; 60/452

(58) Field of Classification Search ..... 60/445, 60/449, 452

See application file for complete search history.

(56) References Cited

U.S. PATENT DOCUMENTS

| | | | | |
|---|---|---|---|---|
| 5,285,642 | A * | 2/1994 | Watanabe et al. | 60/452 |
| 5,468,126 | A | 11/1995 | Lukich | |
| 5,680,760 | A * | 10/1997 | Lunzman | 60/452 |
| 5,784,883 | A * | 7/1998 | Ohkura et al. | 60/449 |
| 6,010,309 | A * | 1/2000 | Takamura et al. | 60/449 |
| 6,378,303 | B1 * | 4/2002 | Higuchi et al. | 60/468 |

FOREIGN PATENT DOCUMENTS

| | | |
|---|---|---|
| EP | 1022395 A1 | 7/2000 |
| EP | 1577563 A2 | 9/2005 |

OTHER PUBLICATIONS

International Search Report for corresponding International Application PCT/SE2006/000323.

* cited by examiner

*Primary Examiner* — Thomas E Lazo
(74) *Attorney, Agent, or Firm* — WRB-IP LLP

(57) ABSTRACT

A method of controlling a work vehicle includes detecting an operational condition of a powertrain which is adapted to propel the vehicle, wherein a power source in the powertrain is adapted to operatively drive at least one variable displacement pump, wherein the pump is adapted to operatively drive at least one hydraulic actuator via hydraulic fluid for moving a work implement and/or steering the vehicle. The method further includes comparing the detected operational condition with a predetermined critical condition, limiting a maximum available displacement of the pump and thereby establishing an available pump displacement range if the magnitude of the detected operational condition is within the predetermined critical condition, detecting a hydraulic load associated to the actuator, and adjusting the pump displacement of the pump in response to the detected hydraulic load within the available pump displacement range.

27 Claims, 2 Drawing Sheets

METHOD AND AN ARRANGEMENT FOR CONTROLLING PUMP DISPLACEMENT IN A WORK VEHICLE

BACKGROUND AND SUMMARY

The present invention relates to a method and an arrangement for controlling pump displacement in a work vehicle.

The term "work vehicle" comprises different types of material handling vehicles like construction machines, such as a wheel loader, an articulated hauler, a backhoe loader, a motor grader and an excavator. Further terms frequently used for work vehicles are "earth-moving machinery" and "off-road work machines". The invention will be described below in a case in which it is applied in a wheel loader. This is to be regarded only as an example of a preferred application. The work vehicles are for example utilized for construction and excavation work, in mines etc.

The work vehicle comprises a powertrain for propelling the vehicle. A power source, preferably an internal combustion engine, and especially a diesel engine, is adapted to provide the power for propelling the vehicle.

The work vehicle further comprises a hydraulic system. The hydraulic system comprises at least one variable displacement pump and at least one actuator operatively driven by hydraulic fluid delivered from said pump. The system may be of load-sensing type, wherein the pump displacement is controlled by a pilot pressure representing a load exerted on the system. The pump is normally operatively driven by the diesel engine.

Said actuator may be a linear actuator in the form of a hydraulic cylinder. A wheel loader comprises several such hydraulic cylinders in order to perform certain functions. A wheel loader is frame-steered and a first pair of hydraulic cylinders is arranged for turning the wheel loader. Further, there are hydraulic cylinders provided for lifting a load arm unit and tilting an implement, for example a bucket, arranged on the load arm unit.

A load sensing hydraulic system is characterized by that the operating condition of the load is sensed and that the output pressure of the pump is controlled so that it exceeds the load pressure existing in the hydraulic actuator by a predetermined differential.

In order for the work vehicle to function well, the engine, transmission and hydraulic system must be balanced with regard to available power and output power. It is difficult to find an engine that exactly manages the desired power outputs at different engine speeds. The problem with different output power demand is particularly pronounced at low engine speeds. If the driver utilizes the power from the engine at low engine speeds to drive the vehicle's half shafts at the same time as the hydraulic system is activated, then there is a risk that the engine will cut out or that the engine will "stick", that is it will not be able to increase the engine speed when the driver depresses the accelerator pedal. The driver can, of course, adjust the power consumption via various controls, when he senses a loss of engine speed, but this can be problematical, particularly when the engine suddenly cuts out. Further, even skilled drivers overcompensate and therefore unnecessarily reduce the amount of hydraulic work the hydraulic system is truly capable of performing. As a result, machine productivity is reduced.

It is desirable to achieve a method for controlling pump displacement in a work vehicle with a load-sensing hydraulic system that creates conditions for limiting the hydraulic power in order to relieve the load on the power source when necessary. The invention is especially directed to a work vehicle with an internal combustion engine as power source and the method particularly aims for relieving engine load, especially when there is a risk for stalling the engine.

A method according to an aspect of the present invention comprises the steps of

- detecting an operational condition of a powertrain which is adapted to propel the vehicle, wherein a power source in the powertrain is adapted to operatively drive at least one variable displacement pump, wherein the pump is adapted to operatively drive at least one hydraulic actuator via hydraulic fluid for moving a work implement and/or steering the vehicle,
- comparing the detected operational condition with a predetermined critical condition,
- limiting a maximum available displacement of the pump and thereby establishing an available pump displacement range if the magnitude of the detected operational condition is within the predetermined critical condition,
- detecting a hydraulic load associated to the actuator, and
- adjusting the pump displacement of the pump in response to the detected hydraulic load within the established available pump displacement range.

In fact, the maximum pump capacity is decreased by means of the step "limiting a maximum available displacement of the pump and thereby establishing an available pump displacement range". Thus, when the critical condition is reached, the maximum capacity of the pump is decreased, wherein the pump will function as a smaller pump than it is in fact. The pump will always/continuously function as a normal load-sensing pump up to the established maximum available displacement. Preferably, the maximum available pump displacement is controlled proportionally with regard to the magnitude of the detected operational condition within the critical condition range.

The powertrain is adapted to propel the vehicle via ground engaging members (wheels or crawlers). The powertrain comprises the power source and a system for transmitting power from the power source to the ground engaging members. According to one preferred example, the powertrain is of a mechanical type and preferably comprises from the power source to the ground engaging members the following: a clutch and/or a torque converter, a transmission, a cardan shaft, a differential gear and transverse half shafts.

The power source (prime mover) is adapted to provide a motive power for propelling the vehicle and to operatively drive the variable displacement pump. The power source is preferably an internal combustion engine, especially a diesel engine.

The predetermined critical condition is preferably formed by a condition range and is indicative of a risk for the power source being overloaded, such as engine lugging/engine shutting off. Preferably, an operational condition of the power source itself is detected.

The actuator is adapted to perform a work function (moving a work implement, such as a bucket or forks) or steer the work vehicle. The actuator is preferably formed by a hydraulic cylinder. The actuator is controlled by manual operation of a control element (lever or joystick).

The hydraulic load associated to the actuator is indicative of an external load exerted on the actuator from a steering operation or from operation of the implement. The load is preferably detected by sensing a hydraulic pressure in a hydraulic system comprising the pump and actuator(s). The displacement of the pump is preferably automatically adjusted within the established pump displacement range in response to the sensed hydraulic pressure. Thus, the hydraulic system is preferably of a load sensing type.

According to a preferred embodiment, the method comprises the steps of determining the maximum available pump displacement on the basis of the magnitude of the detected operational condition. Preferably, the maximum available pump displacement is limited to a larger extent upon a smaller magnitude of the detected operational condition.

According to a further preferred embodiment, the method comprises the steps of continuously variably controlling the magnitude of the limitation of the maximum available pump displacement on the basis of the magnitude of the detected operational condition. Thus, the maximum available pump displacement could be fast and accurately controlled in response to a change in the operational condition.

According to a further preferred embodiment, the method comprises the steps of detecting a hydraulic pressure associated to the actuator, comparing the detected hydraulic pressure with a predetermined limit value and only limiting the maximum available pump displacement if the detected hydraulic pressure is above the predetermined limit value. Thus, there is no need for limiting the maximum available pump displacement if the detected hydraulic pressure is below the predetermined limit value.

According to a further preferred embodiment, the method comprises the steps of detecting a torque or output power of the power source and limiting the maximum available pump displacement if the magnitude of the detected torque or output power is below a predetermined torque or output power value. Thus, there is no need for limiting the maximum available pump displacement if the detected torque or output power is above the predetermined limit value.

It is desirable to achieve an arrangement for controlling pump displacement in a work vehicle with a load-sensing hydraulic system that creates conditions for limiting the hydraulic power to relieve the load on the power source when necessary. An aspect of the invention is especially directed to a work vehicle with an internal combustion engine as power source and the arrangement particularly aims for relieving engine load, especially when there is a risk for stalling the engine.

An arrangement according to an aspect of the invention comprises

- at least one variable displacement pump operatively driven by a power source,
- at least one actuator operatively driven by hydraulic fluid delivered from said pump for moving a work implement and/or steering the vehicle,
- means for detecting an operational condition of a powertrain, wherein the powertrain comprises the power source and is adapted to propel the vehicle,
- means for comparing the detected operational condition value with a predetermined critical condition,
- means for limiting a maximum available displacement of the pump and thereby establishing an available pump displacement range if the magnitude of the detected operational condition is within the predetermined critical condition,
- load sensing means for detecting a hydraulic load associated to the actuator, and
- means for adjusting the pump displacement in response to the detected hydraulic load within the established available pump displacement range.

Further preferred embodiments and advantages will be apparent from the following description and drawings.

BRIEF DESCRIPTION OF THE DRAWINGS

The invention will be explained below, with reference to the embodiments shown on the appended drawings, wherein.

DETAILED DESCRIPTION

Figure 1:
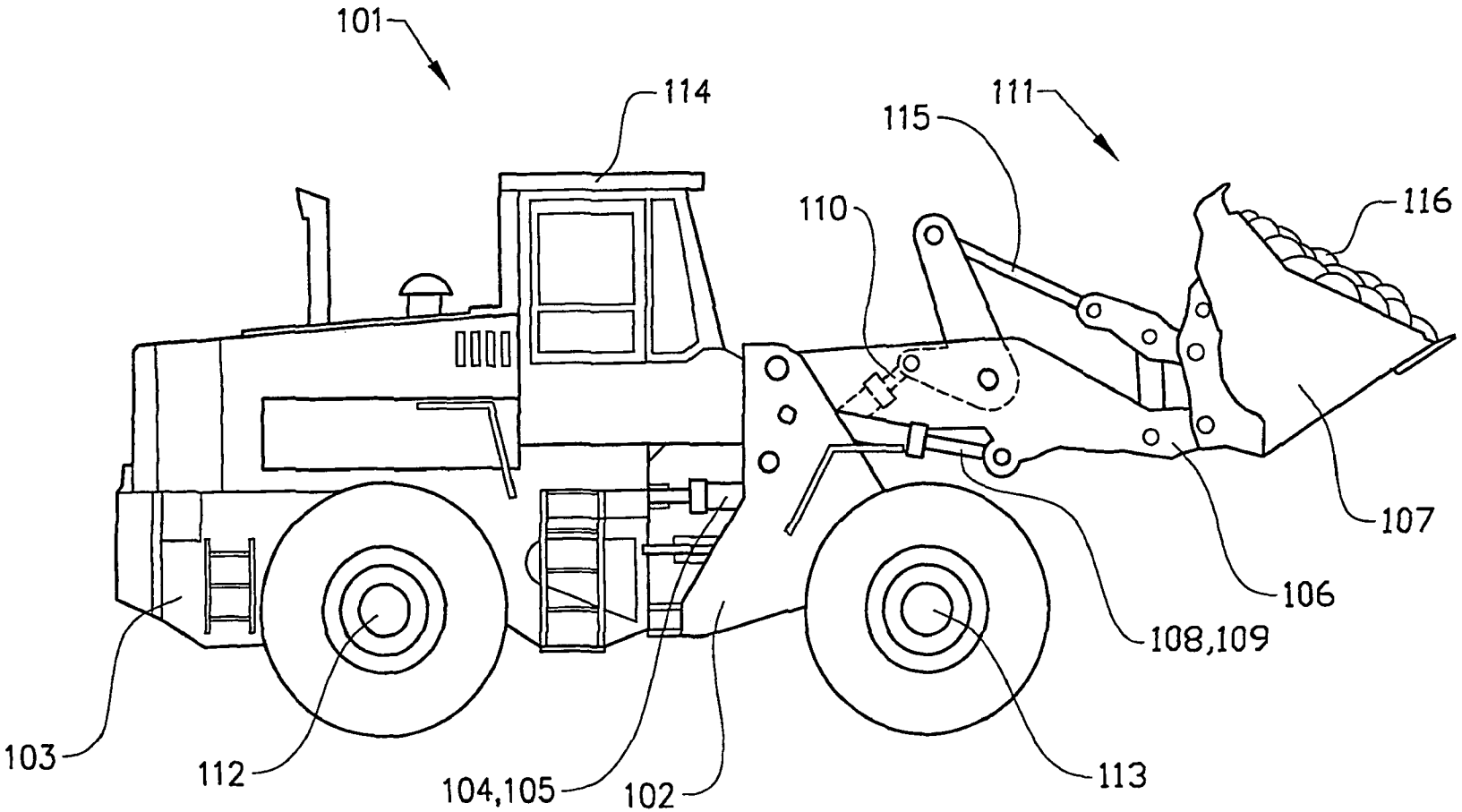
FIG. 1 shows a wheel loader in a side view, and FIG. 2 schematically shows an exemplary embodiment of an arrangement for controlling pump displacement.

FIG. 1 shows a wheel loader 101. The body of the wheel loader 101 comprises a front body section 102 with a front frame, and a rear body section 103 with a rear frame, which sections each has a pair of half shafts 112,113. The rear body section 103 comprises a cab 114. The body sections 102,103 are connected to each other via an articulation joint in such a way that they can pivot in relation to each other around a vertical axis. The pivoting motion is achieved by means of two first actuators in the form of hydraulic cylinders 104,105 arranged between the two sections. Thus, the wheel loader is an articulated work vehicle. The hydraulic cylinders 104,105 are thus arranged one on each side of a horizontal centerline of the vehicle in a vehicle traveling direction in order to turn the wheel loader 101.

The wheel loader 101 comprises an equipment 111 for handling objects or material. The equipment 111 comprises a load-arm unit 106 and a work implement 107 in the form of a bucket fitted on the load-arm unit. A first end of the load-arm unit 106 is pivotally connected to the front vehicle section 102. The implement 107 is pivotally connected to a second end of the load-arm unit 106.

The load-arm unit 106 can be raised and lowered relative to the front section 102 of the vehicle by means of two second actuators in the form of two hydraulic cylinders 108,109, each of which is connected at one end to the front vehicle section 102 and at the other end to the load-arm unit 106. The bucket 107 can be tilted relative to the load-arm unit 106 by means of a third actuator in the form of a hydraulic cylinder 110, which is connected at one end to the front vehicle section 102 and at the other end to the bucket 107 via a link-arm system 115.

Figure 2:
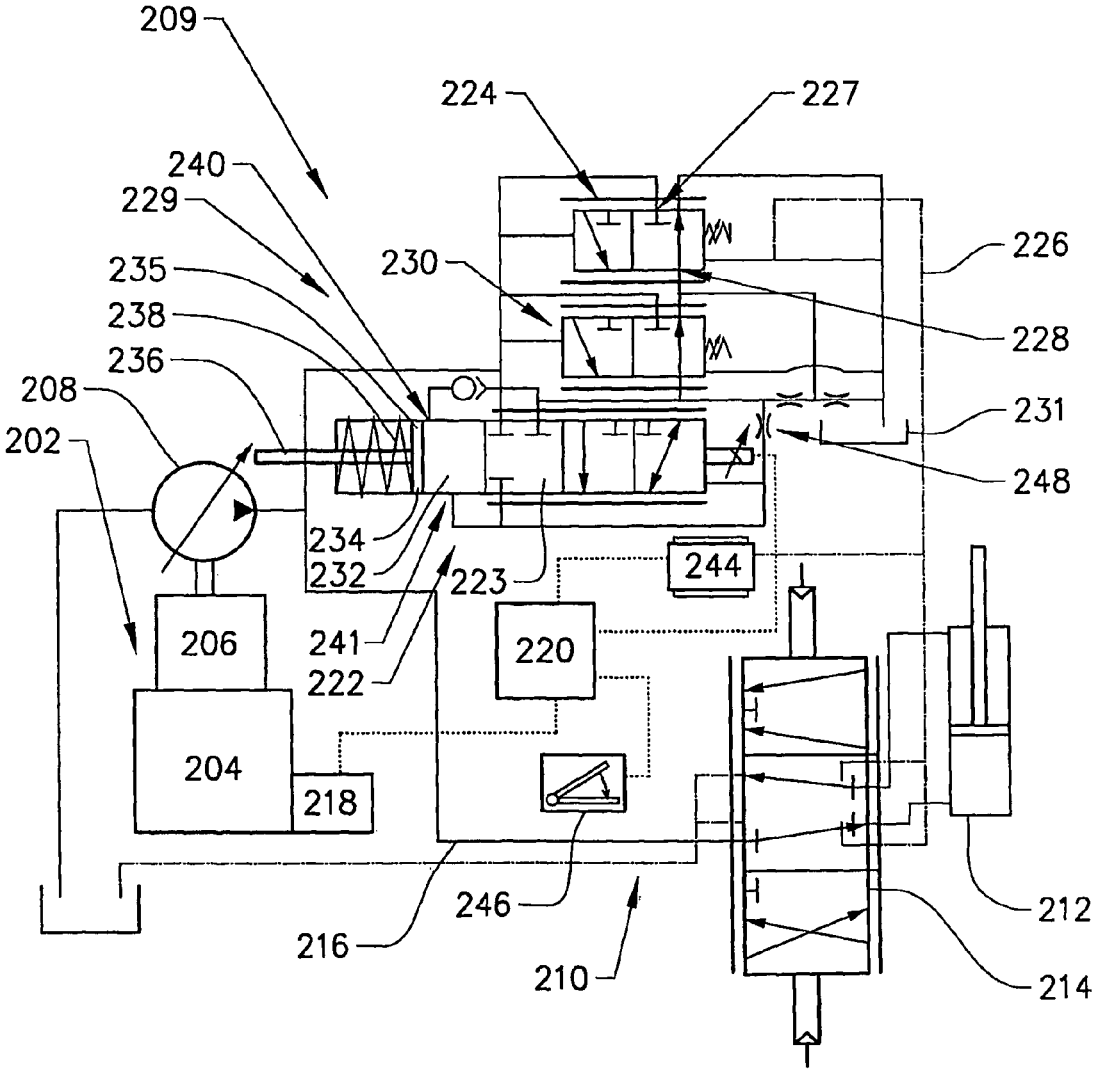

FIG. 2 discloses parts of the wheel loader's powertrain 202, which is adapted to propel the vehicle. The powertrain 202 comprises a diesel engine 204 and a transmission 206 operatively connected to the engine 204. The half shafts 112,113, see FIG. 1, are drivingly connected to the transmission 206 via cardan shafts (not shown).

FIG. 2 further discloses an arrangement 209 for controlling pump displacement in the work vehicle. The control arrangement 209 comprises parts of a hydraulic system 210. The hydraulic system 210 comprises a variable displacement pump 208. Due to the variable displacement, the hydraulic output of the pump 208 can be effectively controlled. The pump 208 is adapted to operatively drive at least one hydraulic actuator 212 via hydraulic fluid. The actuator 212 in FIG. 2 is representative of any one of the hydraulic cylinders 104, 105,108,109,110 in FIG. 1. An electrically operated directional valve unit 214 is arranged on a conduit 216 between the pump 208 and the actuator 212 for controlling delivery of hydraulic fluid to the actuator. The directional valve 208 is preferably solenoid operated. The engine 204 is adapted to operatively drive the pump 208 via the transmission 206.

The control arrangement 209 further comprises means 218 for detecting an operational condition of the powertrain 202 and generating a corresponding signal. More specifically, the detection means 218 is arranged for detecting an operational condition of the power source 204. Said detection means 218 (sensors) may be adapted to sense a reduction of a value of the operation state, for example a change in the engine speed, resulting from excessive hydraulic loads, and producing parameter signals in response to the detected operating state.

The control arrangement 209 further comprises a controller 220 for receiving the signal from the detection means 218. The controller 220 comprises means for comparing the detected operational condition value with a predetermined critical condition and generating a corresponding signal. Said comparing means comprises software code for performing the evaluation. Thus, the controller is programmed with certain algorithms.

The control arrangement 209 farther comprises means 222 for limiting a maximum available displacement of the pump 208. The displacement limiting means 222 is operatively connected to the controller 220 for receiving the generated signal from the controller. A limited, maximum available pump displacement range is established if the magnitude of the detected operational condition is within the predetermined critical condition. The means 222 for limiting a maximum available pump displacement comprises an electrically controlled valve unit 223, which will be described in more detail below.

The hydraulic system 210 is load sensing and the pump displacement is automatically controlled within the established pump displacement range. A pressure signal is generated representing a load associated to the actuator 212, see dotted line 226. A load sensing means 224 is adapted for receiving the load signal. The load sensing means 224 comprises a continuously variable valve unit. The load sensing valve unit 224 is spring loaded and arranged so that a pump delivery pressure acts on one side of the valve unit and the pressure signal from the actuator 212 acts on the opposite side of the valve unit. The valve unit 224 comprises an inlet port 227 connected to the pump 208 and an outlet port 228 connected to a means 229 for adjusting the pump displacement in response to the detected hydraulic load within the available pump displacement range. During operation, the position of the valve unit 224 will continuously vary depending on the hydraulic pressures acting on its opposite sides.

In other words, the displacement of said pump 208 is controlled by a load signal (pressure signal) representing an actual load. Thus, the pump displacement is controlled automatically in response to the requirement of the hydraulic function.

A spring loaded pressure relief valve 230 is arranged in fluid connection between the pump 208 and a fluid container 231 in order to protect the pump.

Turning now to the design and operation of the valve unit 223, which is adapted for limiting a maximum available displacement of the pump 208. The valve unit 223 comprises a housing, or cylinder, defining a chamber 232 and a force transmitting element 234 which is movably arranged in the chamber 232 and adapted to mechanically effect the limitation of the maximum available pump displacement. The force transmitting element 234 comprises a piston 235 and a piston rod 236 mechanically connected to the piston 235. Thus, the piston 235 is reciprocally arranged in the cylinder.

The pump 208 preferably comprises a swash plate, which is rotatable for varying pump displacement. The force transmitting element 234 is mechanically coupled to the swash plate for pivoting the same and set it in a desired position. More specifically, the displacement control works against spring force.

A movement range of the swash plate is limited in response to an electric signal from the controller 220. More specifically, the complete slide in the valve unit 223, comprising the force transmitting element 234, is moved to a position, in which the pump displacement is further limited upon detection of a lower engine operational condition within the critical operational condition range.

Said means 222 for limiting a maximum available pump displacement comprises means 238 for establishing a counterforce on a first side of the force transmitting element 235, acting against movement of the force transmitting element in a direction towards the first side. The means 238 for establishing a counterforce comprises a spring adapted to effect the force transmitting element.

The valve unit 223 comprises at least a first port 240 for entering hydraulic fluid to the chamber on a second side of the force transmitting member 234, which is opposite the counterforce means 238. The chamber 232 is thereby pressurized. The outlet port 228 of the load sensing valve unit 224 is in fluid connection with the first port 240. The pump displacement is thereby controlled in that the position of the force transmitting element 234 is controlled (within the available pump displacement range) by means of the pressure directed from the load sensing valve unit 224. More specifically, the force transmitting element 234 will overcome the spring force and be moved further to the left in FIG. 2 upon a larger detected load.

The valve unit 223 further comprises a second port 242 for removal of hydraulic fluid from the chamber 232 to a fluid container 231. Thus, during operation, the load sensing means 224 supplies hydraulic fluid to the chamber 232, the force transmitting member 234 will be balanced, and hydraulic fluid may leak to the container 231 while maintaining the pressure in the chamber 232.

The solid lines in FIG. 2 indicate main hydraulic conduits, the lines with a longer dash followed by a shorter dash indicate pilot hydraulic conduits and the dotted lines indicate lines for electric signals.

According to a first embodiment of the invention, the power source operational condition detection means 218 is adapted for detecting a torque or output power of the power source. In this embodiment, the engine torque is sensed. The pressure in a clutch in the transmission may be used as a measure of the engine torque. Such clutch pressure signals are directly related to the torque being transmitted by the clutch to the wheels and by the wheels to the ground. When the torque falls to a predetermined minimum, the controller 220 will output a signal with a level as a function of accessible engine torque. As an alternative, the controller 220 will output a signal with a level as a function of both accessible engine torque and the detected position of an accelerator pedal 246.

According to a second embodiment, the engine speed is sensed by the detection means 218. When the engine speed falls to a predetermined minimum, the controller 220 will output a signal with a level as a function of the detected engine speed. As an alternative, the controller 220 will output a signal with a level as a function of both the detected engine speed and the detected position of an accelerator pedal 246.

The engine speed sensor may be a magnetic pick-up device sensitive to the movement of a gear tooth in the engine, which is proportional to crankshaft speed.

According to a variant of the first and second embodiments, a limit value for a minimum engine speed is set. This limit value defines the critical region, in which the maximum available pump displacement is controlled. Further, within this established critical region, the detected torque or output power of the power source is used to control the level of the maximum available pump displacement.

According to a specific example, the maximum available pump displacement is limited to 60% of the maximum pump displacement at a detected engine speed of 700 rpm, to 70% of the maximum pump displacement at a detected engine speed of 800 rpm, to 80% of the maximum pump displacement at a detected engine speed of 900 rpm, to 90% of the maximum pump displacement at a detected engine speed of 1000 rpm and to 100% of the maximum pump displacement at a detected engine speed of 1200 rpm.

According to a third embodiment, a turbocharger is operatively connected to the engine. The turbocharger pressure is sensed. When the turbocharger pressure falls to a predetermined minimum, the controller 220 will output a signal with a level as a function of the detected turbocharger speed. As an alternative, the controller will output a signal with a level as a function of both the detected turbocharger pressure and the detected position of an accelerator pedal 246.

The control arrangement 209 further comprises means 244 for detecting a hydraulic pressure associated to the actuator 212 and generating a corresponding signal. The pressure detection means 244 is adapted to sense the pressure in the load-sensing pressure conduit 226. According to an alternative, the pressure detection means 244 is adapted to sense the pressure in the conduit 216 delivering hydraulic fluid to the actuator 212. The controller 220 is adapted to receive the pressure signal and comprises means for comparing the detected hydraulic pressure with a predetermined limit value. The controller 220 is connected to the detection means 244 for evaluating the detected operation state and generating an operation state signal. This feature creates conditions for controlling the pump 208 to deliver a high flow also at low engine speeds provided the hydraulic pressure is low.

According to one embodiment, the maximum available pump displacement is only controlled when the detected engine speed is below a predetermined limit value (for example 1200 rpm) or when the detected hydraulic pressure is above a predetermined limit value. Thus, the maximum available pump displacement is not interfered with when the detected engine speed is above the predetermined engine speed limit value or when the detected hydraulic pressure is below the predetermined pressure limit value.

At least one flow restrictor 248, or orifice, is arranged on a conduit connecting the second port 241 of the valve unit 223 and the container 231. This restrictor 248 ensures that hydraulic fluid is maintained in the chamber 232 for the displacement control.

In the above described hydraulic system with a single pump 208, the maximum pump displacement should not be limited to such an extent that the steering function is substantially deteriorated.

The invention is also directed to a computer program comprising code means for performing the method steps described above when said program is run on a computer. Said computer program is loaded in a memory in the controller 220. Said computer program may be sent to the controller by wireless technique, for example via the internet.

The invention is further directed to a computer program product comprising program code means stored on a computer readable medium for performing the method described above when said program product is run on a computer. Said computer readable medium may be in the form of a floppy disk or a CD-ROM.

The invention has above been described for solving the problem of limiting hydraulic power output at low engine speeds. The invention may of course also be used for limiting hydraulic power also at high engine speeds, which may be necessary when an engine with "too little" power is used for an arrangement where "too high" power outputs are demanded.

The invention is not in any way limited to the above described embodiments, instead a number of alternatives and modifications are possible without departing from the scope of the following claims.

According to one alternative to the above described mechanical powertrain, the powertrain is at least partly adapted to transmit hydraulic power and/or electric power from the power source to the ground engaging members.

According to one alternative to the above described diesel engine, also other power sources, such as gasoline operated internal combustion engines, electric motors, alternative fuel prime movers and fuel cells could be used.

According to one alternative to using a single variable displacement pump, the hydraulic system comprises at least two pumps for delivering hydraulic fluid to said actuator. At least one of these pumps is a variable displacement pump. According to one example, only the pump that is adapted to deliver hydraulic fluid to the work functions will be limited with regard to pump displacement.

According to one alternative to detecting a rotational speed of an output shaft of the power source itself, a rotational speed of a rotational element in some other part of the powertrain (for example in the transmission), which is indicative of the engine speed, may be detected.

According to one alternative to using a spring for achieving the counterforce on the force transmitting element 235 in the valve unit 223, a hydraulic pressure may be generated.

The invention claimed is:

1. A method for controlling pump displacement in a work vehicle, comprising detecting an operational condition of a powertrain which is adapted to propel the vehicle, wherein a power source in the powertrain is adapted to operatively drive at least one variable displacement pump, wherein the pump is adapted to operatively drive at least one hydraulic actuator via hydraulic fluid for moving a work implement and/or steering the vehicle, comparing the detected operational condition with a predetermined critical condition, limiting a maximum available displacement of the pump and thereby establishing an available pump displacement range if the magnitude of the detected operational condition is within the predetermined critical condition, detecting a hydraulic load associated to the actuator, and adjusting the pump displacement of the pump in response to the detected hydraulic load within the established available pump displacement range, and detecting a hydraulic pressure associated to the actuator, comparing the detected hydraulic pressure with a predetermined limit value and only limiting the maximum available pump displacement if the detected hydraulic pressure is above the predetermined limit value.

2. A method according to claim 1, comprising determining the maximum available pump displacement on the basis of the magnitude of the detected operational condition.

3. A method according to claim 2, comprising continuously variably controlling the magnitude of the limitation of the maximum available pump displacement on the basis of the magnitude of the detected operational condition.

4. A method according to claim 1, comprising limiting the maximum available pump displacement to a larger extent upon a smaller magnitude of the detected operational condition.

5. A method according to claim 1, wherein the operational condition is indicative of a rotational speed of the power source.

6. A method according to claim 1, comprising detecting the operational condition of the power source.

7. A method according to claim 1, comprising detecting a torque or output power of the power source and limiting the maximum available pump displacement if the magnitude of the detected torque or output power is below a predetermined torque or output power value.

8. A method according to claim 1, wherein the power source is an internal combustion engine.

9. A method according to claim 8, comprising detecting a position of an accelerator pedal.

10. A computer program comprising code means for performing all the method steps described in claim 1 when the program is nm on a computer.

11. A computer program product comprising program code stored on a non-transitory computer readable medium for performing the method described in claim 1.

12. A method for controlling pump displacement in a work vehicle, comprising detecting an operational condition of a powertrain which is adapted to propel the vehicle, wherein a power source in the powertrain is adapted to operatively drive at least one variable displacement pump, the power source being an internal combustion engine, wherein the pump is adapted to operatively drive at least one hydraulic actuator via hydraulic fluid for moving a work implement and/or steering the vehicle, comparing the detected operational condition with a predetermined critical condition, limiting a maximum available displacement of the pump and thereby establishing an available pump displacement range if the magnitude of the detected operational condition is within the predetermined critical condition, detecting a hydraulic load associated to the actuator, and adjusting the pump displacement of the pump in response to the detected hydraulic load within the established available pump displacement range, and detecting an engine speed and limiting the maximum available pump displacement if the magnitude of the detected engine speed is below a predetermined engine speed value.

13. A method for controlling pump displacement in a work vehicle, comprising detecting an operational condition of a powertrain which is adapted to propel the vehicle, wherein a power source in the powertrain is adapted to operatively drive at least one variable displacement pump, the power source being an internal combustion engine, wherein the pump is adapted to operatively drive at least one hydraulic actuator via hydraulic fluid for moving a work implement and/or steering the vehicle, comparing the detected operational condition with a predetermined critical condition, limiting a maximum available displacement of the pump and thereby establishing an available pump displacement range if the magnitude of the detected operational condition is within the predetermined critical condition, and detecting a hydraulic load associated to the actuator, and adjusting the pump displacement of the pump in response to the detected hydraulic load within the established available pump displacement range, wherein a turbocharger is operatively connected to the engine, comprising detecting a turbocharger pressure and limiting the maximum available pump displacement if the magnitude of the detected turbocharger pressure is below a predetermined turbocharger pressure value.

14. An arrangement for controlling pump displacement in a work vehicle comprising at least one variable displacement pump operatively driven by a power source, at least one actuator operatively driven by hydraulic fluid delivered from the pump for moving a work implement and/or steering the vehicle, means for detecting an operational condition of a powertrain, wherein the powertrain comprises the power source and is adapted to propel the vehicle, means for comparing the detected operational condition value with a predetermined critical condition, means for limiting a maximum available displacement of the pump and thereby establishing an available pump displacement range if the magnitude of the detected operational condition is within the predetermined critical condition, and load sensing means for detecting a hydraulic load associated to the actuator, and means for adjusting the pump displacement in response to the detected hydraulic load within the established available pump displacement range wherein the means for limiting a maximum available pump displacement comprises an electrically controlled valve unit, and the valve unit comprises a housing defining a chamber and a force transmitting element which is movably arranged in the chamber and adapted to mechanically effect the limitation of the maximum available pump displacement.

15. A control arrangement according to claim 14, wherein the force transmitting element is adapted to be moved for effecting the pump displacement upon receipt of an electric signal of the electrically controlled valve unit.

16. A control arrangement according to claim 14, wherein the means for limiting a maximum available pump displacement comprises means for establishing a counterforce on a first side of the force transmitting element, acting against movement of the force transmitting element in a direction towards the first side.

17. A control arrangement according to claim 16, wherein the means for establishing a counterforce comprises a spring adapted to effect the force transmitting element.

18. A control arrangement according to claim 16, wherein the valve unit comprises at least a first port for entering hydraulic fluid to the chamber on a second side of the force transmitting member, which is opposite the counterforce means and thereby pressurizing the chamber.

19. A control arrangement according to claim 18, wherein the load sensing means for detecting a hydraulic load is connected to the first port of the valve unit in order to direct hydraulic fluid to the chamber in response to the magnitude of the detected load.

20. A control arrangement according to claim 14, comprising means for detecting a hydraulic pressure associated to the actuator and means for comparing the detected hydraulic pressure with a predetermined limit value.

21. A control arrangement according to claim 14, comprising means for detecting an operational condition of the power source.

22. A control arrangement according to claim 14, comprising means for detecting a torque or output power of the power source.

23. A control arrangement according to claim 14, wherein the power source is an internal combustion engine.

24. A control arrangement according to claim 23, comprising means for detecting an engine speed.

25. A control arrangement according to claim 23, wherein a turbocharger is operatively connected to the engine.

26. A control arrangement according to claim 14, comprising means for detecting a position of an accelerator pedal.

27. A work vehicle comprising the control arrangement according to claim 14.

* * * * *